US011668025B2

(12) United States Patent
Threlkeld

(10) Patent No.: US 11,668,025 B2
(45) Date of Patent: Jun. 6, 2023

(54) CONDUCTIVE YARN/SEWING THREAD, SMART FABRIC, AND GARMENT MADE THEREFROM

(71) Applicant: SUPREME CORPORATION, Hickory, NC (US)

(72) Inventor: James O Threlkeld, Indian Trail, NC (US)

(73) Assignee: SUPREME CORPORATION, Hickory, NC (US)

( * ) Notice: Subject to any disclaimer, the term of this patent is extended or adjusted under 35 U.S.C. 154(b) by 453 days.

(21) Appl. No.: 15/277,397

(22) Filed: Sep. 27, 2016

(65) Prior Publication Data

US 2018/0087191 A1 Mar. 29, 2018

(51) Int. Cl.
*D02G 3/44* (2006.01)
*D02G 3/36* (2006.01)

(52) U.S. Cl.
CPC ..... *D02G 3/441* (2013.01); *D02G 3/36* (2013.01); *D10B 2101/20* (2013.01)

(58) Field of Classification Search
CPC ..... D02G 3/39; D02G 3/12; D02G 3/448; D02G 3/442; D02G 3/38; D02G 3/185; D02G 3/441; D02G 3/36; A41D 19/01511; A41D 1/002; D10B 2101/20; D03D 13/004; D03D 15/00
USPC ..... 66/171; 2/167
See application file for complete search history.

(56) References Cited

U.S. PATENT DOCUMENTS 4,470,251 A * 9/1984 Bettcher ..... A41D 19/01511 57/230
4,583,987 A * 4/1986 Kurz ..... D06P 1/0004 252/8.81
4,777,789 A * 10/1988 Kolmes ..... D02G 3/12 2/167
4,793,130 A * 12/1988 Togashi ..... D02G 3/12 57/210
4,838,017 A * 6/1989 Kolmes ..... D02G 3/12 2/167
4,936,085 A * 6/1990 Kolmes ..... D02G 3/185 57/210
5,070,540 A * 12/1991 Bettcher ..... A41D 19/0058 2/2.5
5,177,948 A * 1/1993 Kolmes ..... D02G 3/185 57/229
5,644,907 A * 7/1997 Kolmes ..... D02G 3/12 57/212
5,655,358 A * 8/1997 Kolmes ..... D02G 3/12 57/212
6,279,305 B1 * 8/2001 Hummel ..... A41D 19/01511 57/210
6,349,531 B1 * 2/2002 Kolmes ..... D02G 3/442 57/229
6,363,703 B1 * 4/2002 Kolmes ..... A41D 19/01505 57/210
6,467,251 B1 * 10/2002 Kolmes ..... A41D 31/0055 57/210
RE38,136 E * 6/2003 Kolmes ..... D02G 3/12 57/212
6,828,023 B2 * 12/2004 Broome ..... D02G 3/404 428/375
6,941,775 B2 * 9/2005 Sharma ..... A41D 13/1281 2/902
7,111,445 B2 * 9/2006 Threlkeld ..... D02G 3/443 57/229
2001/0022096 A1 * 9/2001 Orima ..... D02G 3/12 66/170
2002/0187345 A1 * 12/2002 Andrews ..... D02G 3/12 428/365

(Continued)

FOREIGN PATENT DOCUMENTS

CN 103409869 A 11/2013
GB 2 090 304 A 7/1982

(Continued)

OTHER PUBLICATIONS

RF Cafe, "Copper Wire Properties & Gauge Conversions," indexed on Nov. 14, 2015 via the WayBack Machine https://web.archive.org/web/20151114165304/http://rfcafe.com/references/electrical/wire-cu.htm (Year: 2015).*
Espacenet Translation of JP 2013253337A, Translated on Feb. 2, 2022 (Year: 2022).*
International Search Report and Written Opinion dated Jan. 2, 2018 in PCT/US17/53689, 10 pages.
Japanese Office Action dated Oct. 26, 2021 in Japanese Patent Application No. 2019-538098 (with English translation), 12 pages.
Office Action dated Sep. 6, 2021 in Korean Patent Application No. 2017-0092789 filed Jul. 21, 2017.

(Continued)

*Primary Examiner* — Jocelyn Bravo
(74) *Attorney, Agent, or Firm* — Tucker Ellis LLP

(57) ABSTRACT

A conductive composite yarn having:
a) a core formed of at least one metallic strand of 40 or higher gauge which is electrically conductive;
b) at least one inner cover wrapped around the core in a first direction at a rate sufficient to provide substantially complete coverage of the core by the inner cover, wherein the inner cover is a natural or synthetic yarn;
c) at least one outer cover wrapped around the at least one inner cover, wherein the outer cover is wrapped in a second direction opposite to a direction of a cover layer on which the outer cover is directly wrapped, at a rate sufficient to provide substantially complete cover of the cover layer on which the outer cover is directly wrapped;
d) at least one bonding agent applied onto the at least one outer cover; and
e) optionally, a lubricant.

a conductive composite sewing thread therefrom, and use of the yarn/sewing thread in production of smart fabrics or smart garments having electrical segments, patterns, or grids therein.

14 Claims, No Drawings

(56) References Cited

U.S. PATENT DOCUMENTS

2003/0074879 A1* 4/2003 Patrick ..... D02G 3/12 57/229
2005/0028512 A1* 2/2005 Boni ..... D02G 3/12 57/212
2005/0086924 A1* 4/2005 Kolmes ..... D02G 3/12 57/229
2005/0155336 A1* 7/2005 Robins ..... D02G 3/38 57/210
2006/0048495 A1* 3/2006 Threlkeld ..... D02G 3/443 57/210
2007/0062173 A1* 3/2007 Hummel ..... A41D 19/01511 57/210
2007/0084182 A1* 4/2007 Andrews ..... D02G 3/38 57/232
2008/0098501 A1* 5/2008 Takata ..... A41D 19/01511 2/161.8
2008/0282665 A1* 11/2008 Speleers ..... D02G 3/12 57/212
2009/0299408 A1* 12/2009 Schuldt-Hempe ..... A61L 17/04 606/230
2010/0199901 A1 8/2010 Kang et al.
2011/0072776 A1* 3/2011 De Greve ..... B60N 2/5685 57/211
2014/0113519 A1* 4/2014 Golz ..... D02G 3/442 442/190
2016/0345638 A1* 12/2016 Robinson ..... A41D 1/005
2017/0325518 A1* 11/2017 Poupyrev ..... A41D 1/005

FOREIGN PATENT DOCUMENTS

JP 2-68326 A 3/1990
JP 6-504744 A 6/1994
JP 2013-253337 12/2013
JP 2013253337 A * 12/2013

OTHER PUBLICATIONS

Office Action dated Mar. 10, 2022, in Chinese Patent Application No. 201780068899 w/English translation.

* cited by examiner

CONDUCTIVE YARN/SEWING THREAD, SMART FABRIC, AND GARMENT MADE THEREFROM

BACKGROUND OF THE INVENTION

Field of Invention

The present invention relates to the area of conductive yarns and conductive sewing threads and products made therefrom, particularly in the area of making smart fabrics and smart garments using the conductive yarn/sewing thread.

Discussion of the Background

A demand has developed for smart fabrics and smart garments, having conductive capabilities through the use of conductive yarns used in making of the fabric/garment, thus permitting the operation of electrical sensors, detectors and/or metering devices to measure and track various aspects of the wearer's well-being. Such smart fabrics and garments are particularly sought for use in military and sporting applications. In military uses, such smart fabrics are used to track the wearer's biometric readings, as well as for satellite tracking of individuals in the operational theater.

Unfortunately, previous efforts in providing such conductive yarn have met with limited success. This is particularly the case where the conductive yarn is intended as a sewing thread. Sewing thread, because of the nature of its use, must be able to withstand the stresses created thereon by the many repeated bends and jerks occurring during the conventional sewing operation. Therefore it must be able to endure these bends and stresses without breaking. Since most attempts to make conductive yarn involve the use of a metallic strand as part of the yarn, and metallic strands have a tendency to succumb to such repeated bends and stresses by breaking, conductive sewing threads have been even more difficult to provide, since breaking of the conductive metallic strand results in a break in the conductivity.

Another problem with conductive sewing thread is the need to be able to sew the conductive thread across itself without causing an electrical short circuit.

There still exists a need for a conductive yarn, and particularly for a conductive sewing thread that, in addition to functioning as a yarn or sewing thread, will with stand the bends and stresses of use, particularly in sewing, while maintaining sufficiently high conductivity to provide the conductive benefits intended. In such a case the sewing thread must maintain its integrity through the sewing process, and must not result in shorting out the electrical circuit when the thread is sewn across itself.

SUMMARY OF THE INVENTION

Accordingly, one object of the present invention is to provide a conductive composite yarn, and particularly a conductive composite sewing thread that enables the production of conductive patterns in a fabric.

A further object of the present invention is to provide a smart fabric made using the conductive composite yarn/sewing thread of the present invention.

A further object of the present invention is to provide a garment made using the smart fabric of the present invention.

These and other objects of the present invention have been satisfied, either individually or in combination, by the discovery of a conductive composite yarn/sewing thread comprising:

a) a core formed of at least one strand of a conductive metal of 40 or higher gauge, b) at least one inner cover wrapped around the core in a first direction at a rate sufficient to provide substantially complete coverage of the core by the inner cover;

c) at least one outer cover wrapped around the at least one inner cover, wherein the outer cover is wrapped in a second direction opposite to a direction of a cover layer on which the outer cover is directly wrapped, at a rate sufficient to provide substantially complete cover one cover layer on which the outer cover is directly wrapped and d) at least one bonding agent; and e) optionally, a lubricant;

and its use in the production of fabrics and garments having conductive segments, patterns and/or grids therein.

DETAILED DESCRIPTION OF THE INVENTION

The present invention relates to a conductive composite yarn comprising a central core having one or more strands of a conductive metal of 40 or higher gauge, an inner cover of one or more strands of a synthetic or natural fiber, which may optionally be a high performance fiber, and an outer cover of a synthetic or natural fiber, such as polyester or nylon strands), treated with a suitable bonding agent, and, optionally, with an outer application of a suitable lubricant. The conductive composite yarn is particularly suitable for use as a sewing thread.

The term "fiber" as used herein refers to a fundamental component used in the assembly of yarns and fabrics. Generally, a fiber is a component which has a length dimension which is much greater than its diameter or width. This term includes ribbon, strip, staple, and other forms of chopped, cut or discontinuous fiber and the like having a regular or irregular cross section. "Fiber" also includes a plurality of any one of the above or a combination of the above.

As used herein, the term "high performance fiber" means that class of synthetic or natural non-glass fibers having high values of tenacity greater than 10 g/denier, such that they lend themselves for applications where high abrasion and/or cut resistance is important. Typically, high performance fibers have a very high degree of molecular orientation and crystallinity in the final fiber structure.

The term "filament" as used herein refers to a fiber of indefinite or extreme length such as found naturally in silk. This term also refers to manufactured fibers produced by, among other things, extrusion processes. Individual filaments making up a fiber may have any one of a variety of cross sections to include round, serrated or, crenular, bean-shaped or others.

Within the context of the present invention, unless otherwise denoted, the terms "polyester" and "nylon" are used generically and include any of the conventional members of the polyester and nylon families of fibers, respectively. Nylon is preferably nylon-6,6. Polyester is preferably polyethylene terephthalate, polypropylene terephthalate or polybutylene terephthalate.

The term "yarn" as used herein refers to a continuous strand of textile fibers, filaments or material in a form suitable for knitting, weaving, or otherwise intertwining to form a textile fabric. Yarn can occur in a variety of forms to include a spun yarn consisting of staple fibers usually bound together by twist; a multi filament yarn consisting of many continuous filaments or strands; or a mono filament yarn which consist of a single strand.

The term "air interlacing" as used herein refers to subjecting multiple strands of yarn to an air jet to combine the strands and thus form a single, intermittently commingled strand. This treatment is sometimes referred to as "air tacking." This term is not used to refer to the process of "intermingling" or "entangling" which is understood in the art to refer to a method of air compacting a multifilament yarn to facilitate its further processing, particularly in weaving processes. A yarn strand that has been intermingled typically is not combined with another yarn. Rather, the individual multifilament strands are entangled with each other within the confines of the single strand. This air compacting is used as a substitute for yarn sizing and as a means to provide improved pick resistance. This term also does not refer to well known air texturizing performed to increase the bulk of single yarn or multiple yarn strands. Methods of air interlacing in composite yarns and suitable apparatus therefore are described in U.S. Pat. Nos. 6,349,531; 6,341,483; and 6,212,914, the contents of which are hereby incorporated by reference.

The term "composite yarn" refers to a yarn prepared from two or more yarns, which can be the same or different. Composite yarn can occur in a variety of forms wherein the two or more yarns are in differing orientations relative to one another. The two or more yarns can, for example, be parallel, wrapped one around the other(s), twisted together, or combinations of any or all of these, as well as other orientations depending on the properties of the composite yarn desired. Examples of such composite yarns are provided in U.S. Pat. Nos. 4,777,789; 5,177,948; 5,628,172; 5,845,476; 6,351,932; 6,363,703 and 6,367,290, the contents of which are hereby incorporated by reference.

In the present invention fire resistant composite yarn, the core comprises one or more metallic conductive strands. The metallic conductive strands can be made of any conductive metal, and preferably are of stainless steel or copper. Preferably, in order to provide sufficient flexibility of the metallic core, the metallic conductive strands should be of 40 or higher gauge metal, more preferably 42 or higher gauge, most preferably 44 or higher gauge. In some preferred embodiments, the core comprises at least 2 metallic strands, which are most preferably insulated one from the other with either a polyamide or polyurethane sheath (the metallic strands having such polymeric sheaths are commercially available). For uses above 150° C., the polyamide covered metallic strand is preferred. When a stainless steel wire is used in the core, the stainless steel wire is preferably of 0.5-4 mil in diameter, more preferably from 1-2 mil in diameter, most preferably 1.6 mil in diameter (0.0016 in). The core can optionally comprise other types of yarn, depending on the intended use. In certain embodiments, the core further comprises fiberglass to improve cut resistance, or can include high performance yarns, such as ultra-high molecular weight polyolefin (such as SPECTRA or DYNEEMA), or aramid yarns. When fiberglass is contained, the fiberglass can be of any weight/rating, including but not limited to those in the following Table 1:

TABLE 1

Standard Fiberglass Sizes

| Fiberglass Size | Approximate Denier |
|---|---|
| G-450 | 99.21 |
| D-225 | 198.0 |
| G-150 | 297.6 |
| G-75 | 595.27 |
| G-50 | 892.90 |
| G-37 | 1206.62 |

The core may be of any desired denier, depending on the unit weight of yarn/sewing thread desired. Preferably, the core has a denier of from 50 to 1500, more preferably from 200 to 900.

The inner and outer cover yarns can be any type of yarn, including both natural and synthetic fibers, and are preferably a synthetic fiber including, but not limited to, polyester, nylon, rayon, cotton, acrylics, etc. In certain embodiments, it may be desirable for the inner cover yarn to be a high performance yarn or high tenacity yarn. Suitable high tenacity yarns include any of the high tenacity yarns having the very low or non-existent elongation, preferably at least one member selected from the group consisting of fiberglass, aramids, and ceramic fibers, most preferably fiberglass. Since this inner cover is helically applied, when subject to the bending stresses generated in the sewing operation, the helical configuration will allow some elongation of the inner cover (even in cases where the yarn used to prepare the inner cover has little to no elongation properties itself) to prevent damage or breakage, particularly in a preferred fiberglass embodiment. The inner cover is wrapped around the core at a rate of turns per inch sufficient to provide coverage of the core, and varies depending on the denier and diameter of the core, as well as the denier of the yarn making up the inner cover. Preferably, the inner cover is wrapped at a rate of from 4 to 15 tpi, more preferably from 6 to 12 tpi. The inner cover yarn may have any desired denier, again depending on the desired size of the final product yarn. Preferably, the inner cover has a denier from 50 to 1500, most preferably from 100 to 1000.

The outer cover maybe made of any desired fiber, including both natural and synthetic fibers, and is preferably a synthetic fiber including, but not limited to, polyester or nylon. Like the inner cover, the outer cover may be any desired denier, depending on the final size of the resulting yarn product and is preferably from 50 to 1500 denier, most preferably from 100 to 1000 denier. The outer cover is then wrapped at a rate sufficient to provide complete coverage of the inner cover, preferably from 4 to 15 tpi, more preferably front to 12 tpi, again depending upon the composite denier of the core/inner cover combination and the denier of the yarn making up the outer cover. The outer cover preferably protects the core and inner cover.

In a fire resistant embodiment of the present invention, the fire resistant sewing thread described in U.S. Pat. No. 7,111,445, the contents of which are hereby incorporated by reference in their entirety, can be used, with the metallic strands of the present invention added to the core. In such preferred embodiments, if the sewn product is present in a fire, the inner cover will remain intact and maintain the fabric sections together, even though the core may melt.

The resulting composite yarn can have any desired composite denier, and preferably has a measured composite denier of from 300 to 2000, more preferably from 500 to 1500, most preferably from 1000 to 1400. While this is the measured composite denier, the resulting yarn has a size comparable to a typical composite denier of a non-metallic containing composite yarn of 150 to 1000, more preferably from 350 to 750, most preferably from 500 to 600. The reason for the much higher measured composite denier is the higher density (and thus higher weight per unit volume) of the metallic strands in the core.

Once the composite yarn is formed, it is subjected to a finishing operation in which at least one bonding agent and, optionally, at least one lubricant is applied. These can be applied in any conventional manner, including but not limited to spraying on the fiber, application by kiss-roll, or dipping the yarn into a bath containing the bonding agent or lubricant, either neat or as a solution in a suitable organic or aqueous solvent. The preferred lubricant is a silicone with paraffin added. Additional lubricants which have been found to be satisfactory are RAYOLAN 1813, Boehme FILATEX, or KL 400 (Kelmar). When the composite yarn is a composite sewing thread, the composite yarn is lubricated so that the sewing thread can withstand the heat of the needle as it repeatedly slides through the needle eye during the sewing operation.

The composite yarn is treated with at least one suitable bonding agent, including but not limited to at least one member selected from the group consisting of polyurethanes, polyacrylics, nylons and other conventional fiber bonding compositions. The bonding can be applied to the assembled core, to the inner cover, or to the outside of the fully assembled composite yarn. Preferably, the bonding is applied to the outside of the fully assembled composite yarn. Once applied, the bonding agent is permitted to dry or cure to provide sufficient bonding of the yarn fibers.

The present invention encompasses various embodiments of conductive yarns/sewing threads, including but not limited to:

- Conductive yarns/sewing threads having 34 or more metallic strands in the core to provide additional high levels of conductivity; these higher levels of metallic strands typically must be balanced with flexibility requirements in order to provide a yarn/sewing thread that can still be sewn, knit or woven;
- Conductive yarns having differing bonding agents, such as polyurethanes or polyamides, depending on the properties sought;
- Conductive reflective yarns/sewing threads wherein the reflective properties are provided, for example, by embedding retroflective beads (in the range of microns or smaller in diameter) in the surface of the yarn/sewing thread;
- Conductive luminescent yarns/sewing threads, in which a photoluminescent yarn is used as at least a part of the outer cover;
- Magnetic conductive yarns/sewing threads, in which an additional magnetic metallic strand (such as a strand of nickel wire having low conductivity but high magnetization properties) is included within the core;
- Color coded conductive yarns/sewing threads, in which the various metallic strands present in the core are each coated with differing color polymeric coatings for ease of identification; and
- Antimicrobial conductive yarns/sewing threads, in which the conductive yarns/sewing threads of the present invention are made antimicrobial through treatment with an antimicrobial composition, such as that set forth in U.S. Pat. No. 7,939,686, the entire contents of which are hereby incorporated by reference in their entirety.

For purposes of illustration, several examples are set forth below:

EXAMPLE 1

Core: two 44 ga copper wires and one 1.6 mil stainless steel wire, each having a polyurethane coating
Inner cover: 70 denier polyester (PET)
Outer cover: 70 denier polyester (PET)
Bonding agent: polyurethane

EXAMPLE 2

Core: two 44 ga copper wires, each having a polyurethane coating
Inner cover: 100 denier polyester (PET)
Outer cover: 100 denier polyester (PET)
Bonding agent: polyamide

EXAMPLE 3

Core: two 40 ga copper wires, each having a polyamide coating
Inner cover: 50 denier polyester (PET)
Outer cover: 70 denier nylon (nylon6,6)
Bonding agent: polyurethane

EXAMPLE 4

Core: four 44 ga copper wires, each having a polyurethane coating
Inner cover: 70 denier Nylon (nylon6,6)
Outer cover: 70 denier polyester (PET)
Bonding agent: polyurethane

EXAMPLE 5

Core: two 44 ga copper wires, each having a polyamide coating, 100 denier SPECTRA
Inner cover: 70 denier polyester (PET)
Outer cover: 70 denier polyester (PET)
Bonding agent: polyurethane

EXAMPLE 6

Core: two 44 ga copper wires, each having a polyamide coating, G-450 fiberglass
Inner cover: 70 denier polyester (PET)
Outer cover: 70 denier polyester (PET)
Bonding agent: polyurethane A preferred embodiment of the present invention a conductive composite sewing thread, having 2 metallic strands in the core, preferably from 44 gauge copper wire. When such a conductive sewn thread is sewn using a standard bobbin type sewing machine, the resulting stitch provides a 4 lead system, thus having capability to provide a power lead, a ground lead and 2 signal leads. Such a system can be used to sew in conductive patterns into a fabric or garment, permitting the connection of various biometric measuring devices, or other electrical In a further embodiment of the present invention, the conductive composite sewing thread has a core formed of two 44 gauge copper wires, and one 1.6 mil stainless steel wire, which provides additional strength to the sewing thread such that it can be sewn using commercial grade sewing machines while still maintaining the desired electrical conductivity properties.

The conductive sewing thread of the present invention can be used to turn any desired fabric or garment into a "smart fabric" or"smart garment". In the context of the present invention, the terms "smart fabric" and "smart garment" are meant to indicate that a conductive pattern or grid, or at least conductive segments have been sewn into the fabric or garment, thus permitting the attachment of electrical leads to the conductive segments/pattern/grid, and enabling the use of the garment to be used for a variety of monitoring or tracking purposes common to such garments. A primary difference with such fabrics or garments made using the present invention is that custom patterns or grids can be readily applied to the garment using a standard sewing machine, without worrying about the yarn crossing itself and causing a short circuit or other electrical fault to occur.

While certain preferred embodiments have been described in detail here and above, it is apparent that various changes may be made without departing from the scope of the invention. For example, as stated here and above, the conductive composite yarn/sewing thread may include multiple strands in the core, multiple strands in the inner cover, and/or multiple strands in the outer cover.

The invention claimed is:

1. A conductive composite yarn comprising:

a) a core formed of at least one strand of copper of 40 or higher gauge, and a stainless steel wire having a diameter of 1-2 mil;

b) at least one inner cover wrapped around the core in a first direction at a rate sufficient to provide substantially complete coverage of the core by the at least one inner cover, wherein the at least one inner cover is a natural or synthetic yarn;

c) at least one outer cover wrapped around the at least one inner cover, wherein the outer cover is wrapped in a second direction opposite to a direction of the at least one inner cover on which the at least one outer cover is directly wrapped, at a rate sufficient to provide substantially complete cover of the at least one inner cover layer on which the at least one outer cover is directly wrapped;

d) at least one bonding agent applied onto the at least one outer cover; and e) optionally, a lubricant, wherein the conductive composite yarn is configured to be sewn using a commercial grade bobbin type sewing machine; and wherein the conductive composite yarn has a first end and a second end, and one or more leads attached at each end.

2. The conductive composite yarn of claim 1, wherein the at least one copper wire strand is a 42 gauge copper wire.

3. The conductive composite yarn of claim 1, wherein the at least one copper wire strand is a 44 gauge copper wire.

4. The conductive composite yarn of claim 1, wherein said core comprises two 40 or higher gauge copper wires.

5. The conductive composite yarn of claim 4, wherein the two copper wires are each of 44 gauge.

6. The conductive composite yarn of claim 1, wherein said at least one outer cover is formed of at least one strand of a yarn selected from the group consisting of nylon and polyester yarns.

7. The conductive composite yarn according to claim 1, wherein said core further comprises fiberglass having a denier of from 100 to 300.

8. The conductive composite yarn according to claim 1, wherein the conductive composite yarn has a composite denier of from 400 to 700.

9. The conductive composite yarn according to claim 1, wherein the conductive composite yarn has a composite denier of from 500 to 600.

10. The conductive composite yarn according to claim 1, wherein the conductive composite yarn includes the lubricant, and wherein the lubricant is a composition comprising silicone and paraffin.

11. A fabric having a conductive segment, pattern or grid, comprising:

a knit or woven fabric, and a segment, pattern or grid formed on the fabric by sewing the conductive composite yarn of claim 1 into the fabric to form the segment, pattern or grid.

12. A garment having a conductive segment, pattern or grid, formed from the fabric of claim 11.

13. A garment having a conductive segment, pattern or grid, comprising:

a garment comprising a fabric, and a segment, pattern or grid formed on the garment by sewing the conductive composite yarn of claim 1 into the fabric to form the segment, pattern or grid.

14. The conductive composite yarn of claim 1, wherein the at least one inner cover provides sufficient coverage of the core that upon sewing in a manner where the conductive composite yarn crosses itself, a short circuit or other electrical fault is avoided.

* * * * *